US010960668B2

(12) United States Patent
Kakamu

(10) Patent No.: US 10,960,668 B2
(45) Date of Patent: Mar. 30, 2021

(54) LIQUID DISCHARGE HEAD AND LIQUID DISCHARGE APPARATUS

(71) Applicant: Brother Kogyo Kabushiki Kaisha, Nagoya (JP)

(72) Inventor: Katsumi Kakamu, Kuwana (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 16/680,663

(22) Filed: Nov. 12, 2019

(65) Prior Publication Data

US 2020/0147965 A1 May 14, 2020

(30) Foreign Application Priority Data

Nov. 13, 2018 (JP) ..... JP2018-212886

(51) Int. Cl.
*B41J 2/14* (2006.01)

(52) U.S. Cl.
CPC .. *B41J 2/14209* (2013.01); *B41J 2002/14225* (2013.01); *B41J 2002/14306* (2013.01); *B41J 2002/14419* (2013.01)

(58) Field of Classification Search
CPC ..... B41J 2/14209; B41J 2002/14225; B41J 2002/14306; B41J 2002/14419
See application file for complete search history.

(56) References Cited

U.S. PATENT DOCUMENTS

| | | | | |
|---|---|---|---|---|
| 10,583,657 | B2 * | 3/2020 | Sugiura | B41J 2/1433 |
| 2012/0188298 | A1 | 7/2012 | Matsumoto et al. | |
| 2017/0182772 | A1 | 6/2017 | Gejima et al. | |

FOREIGN PATENT DOCUMENTS

| | | | |
|---|---|---|---|
| JP | 2011-093131 | A | 5/2011 |
| JP | 2011-143331 | A | 7/2011 |
| JP | 2015-131475 | A | 7/2015 |
| WO | 2015-125865 | A1 | 8/2015 |

* cited by examiner

*Primary Examiner* — Thinh H Nguyen
(74) *Attorney, Agent, or Firm* — Banner & Witcoff, Ltd.

(57) ABSTRACT

A liquid discharge head includes: individual channels including nozzles respectively; first supply channels through which liquid is supplied to the individual channels; first discharge channels through which the liquid is discharged from the individual channels; a second supply channel through which the liquid is supplied to the first supply channels; a second discharge channel to which the liquid is discharged from the first discharge channels; supply connection openings positioned between the first supply channels and the second supply channel and connecting the first supply channels and the second supply channel; discharge connection openings positioned between the first discharge channels and the second discharge channel and connecting the first discharge channels and the second discharge channel; a supply opening through which the liquid is supplied to the second supply channel; and a discharge opening to which the liquid is discharged from the second discharge channel.

21 Claims, 9 Drawing Sheets

LIQUID DISCHARGE HEAD AND LIQUID DISCHARGE APPARATUS

CROSS REFERENCE TO RELATED APPLICATION

The present application claims priority from Japanese Patent Application No. 2018-212886 filed on Nov. 13, 2018, the disclosure of which is incorporated herein by reference in its entirety.

BACKGROUND

Field of the Invention

The present invention relates to a liquid discharge head configured to discharge liquid from nozzles and a liquid discharge apparatus including the liquid discharge head.

Description of the Related Art

There is known a liquid discharge apparatus discharging liquid from nozzles. An exemplary liquid discharge apparatus includes discharge holes and pressurizing chambers. Individual channels arranged in a D1 direction are connected to first common supply channels arranged in a D2 direction intersecting with the D1 direction. Each first common supply channel extends in the D1 direction. A second common supply channel extending in the D2 direction connects end portions on a first side in the D1 direction of the first common supply channels. The liquid is supplied from an opening at an end portion on a first side in the D2 direction to the second common supply channel. Further, in the above liquid discharge apparatus, the individual channels are connected to first common recovery channels arranged in the D2 direction. Each first common recovery channel extends in the D1 direction. A second common recovery channel extending in the D2 direction connects end portions on a second side in the D1 direction of the first common recovery channels. The liquid in the second common recovery channel is recovered through an opening at an end portion on a second side in the D2 direction.

SUMMARY

In the above liquid discharge apparatus, the liquid is supplied from the second common supply channel to the first common supply channels. The liquid is supplied from the opening at the end portion on the first side in the D2 direction to the second common supply channel. In that configuration, the liquid is not likely to flow from the second common supply channel to the first common supply channel positioned farther away from the opening toward the second side in the D2 direction. Further, the liquid is not likely to flow into the second common recovery channel from the first common recovery channel positioned farther away from the opening at the end portion on the first side in the D2 direction toward the second side in the D2 direction.

An object of the present disclosure is to provide a liquid discharge head configured to supply liquid from a second supply channel to first supply channels and to discharge the liquid from first discharge channels to a second discharge channel and allowing the liquid to uniformly flow through each of the first supply channels and each of the first discharge channels, as well as a liquid discharge apparatus including the liquid discharge head.

According to an aspect of the present disclosure, there is provided a liquid discharge head, including: a plurality of individual channels including a plurality of nozzles respectively, a plurality of first supply channels through which liquid is supplied to the individual channels, the first supply channels extending in a first direction and connected to the individual channels, the first supply channels being arranged in a second direction intersecting with the first direction, a plurality of first discharge channels through which the liquid is discharged from the individual channels, the first discharge channels extending in the first direction and connected to the individual channels, the first discharge channels being arranged in the second direction, a second supply channel through which the liquid is supplied to the first supply channels, the second supply channel extending in the second direction and overlapping with the first supply channels in a third direction that intersects with a plane parallel to the first direction and the second direction, a second discharge channel to which the liquid is discharged from the first discharge channels, the second discharge channel extending in the second direction and overlapping with the first discharge channels in the third direction, a plurality of supply connection openings positioned between the first supply channels and the second supply channel in the third direction and connecting the first supply channels and the second supply channel, a plurality of discharge connection openings positioned between the first discharge channels and the second discharge channel in the third direction and connecting the first discharge channels and the second discharge channel, a supply opening through which the liquid is supplied to the second supply channel, and a discharge opening to which the liquid is discharged from the second discharge channel, wherein the supply connection openings include a first supply connection opening and a second supply connection opening, the discharge connection openings include a first discharge connection opening and a second discharge connection opening, the liquid discharge head satisfies at least one of the following: a cross-sectional area orthogonal to the third direction of the first supply connection opening is different from a cross-sectional area orthogonal to the third direction of the second supply connection opening; a cross-sectional area orthogonal to the third direction of the first discharge connection opening is different from a cross-sectional area orthogonal to the third direction of the second discharge connection opening.

Unlike the present disclosure, if the supply connection openings have the same cross-sectional area orthogonal to the third direction, the flowability of liquid from the second supply channel to the first supply channels may greatly vary depending on the distance from the supply opening. Further, if the discharge connection openings have the same cross-sectional area orthogonal to the third direction, the flowability of the liquid from the first discharge channels to the second discharge channel may greatly vary depending on the distance from the discharge opening.

The present disclosure satisfies at least one of the followings: the cross-sectional area orthogonal to the third direction of the first supply connection opening is different from the cross-sectional area orthogonal to the third direction of the second supply connection opening; the cross-sectional area orthogonal to the third direction of the first discharge connection opening is different from the cross-sectional area orthogonal to the third direction of the second discharge connection opening. In that configuration, the first supply connection opening and the second supply connection opening differ in the channel resistance and/or the first discharge connection opening and the second discharge connection opening differ in the channel resistance. This makes the flowability of liquid from the second supply channel to the first supply channels uniform, and makes the flowability of liquid from the first discharge channels to the second discharge channel uniform.

DESCRIPTION OF THE EMBODIMENTS

An embodiment of the present disclosure is explained below.

<Schematic Configuration of Printer>

Figure 1:
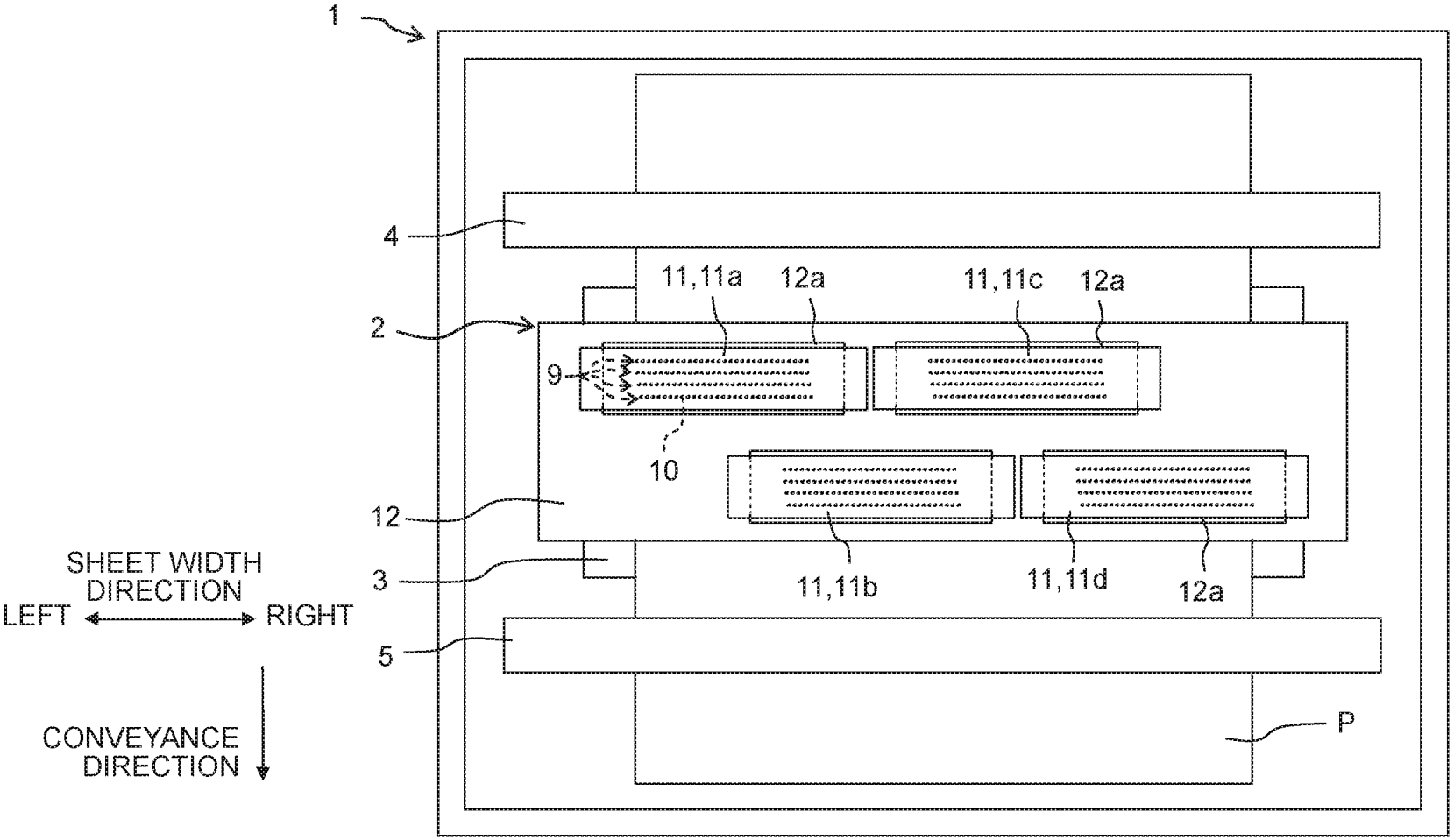
FIG. 1 schematically depicts a configuration of a printer according to an embodiment of the present disclosure.

As depicted in FIG. 1, a printer 1 (a liquid discharge apparatus of the present disclosure) according to this embodiment includes an ink-jet head 2, a platen 3, and conveyance rollers 4, 5.

Figure 2:
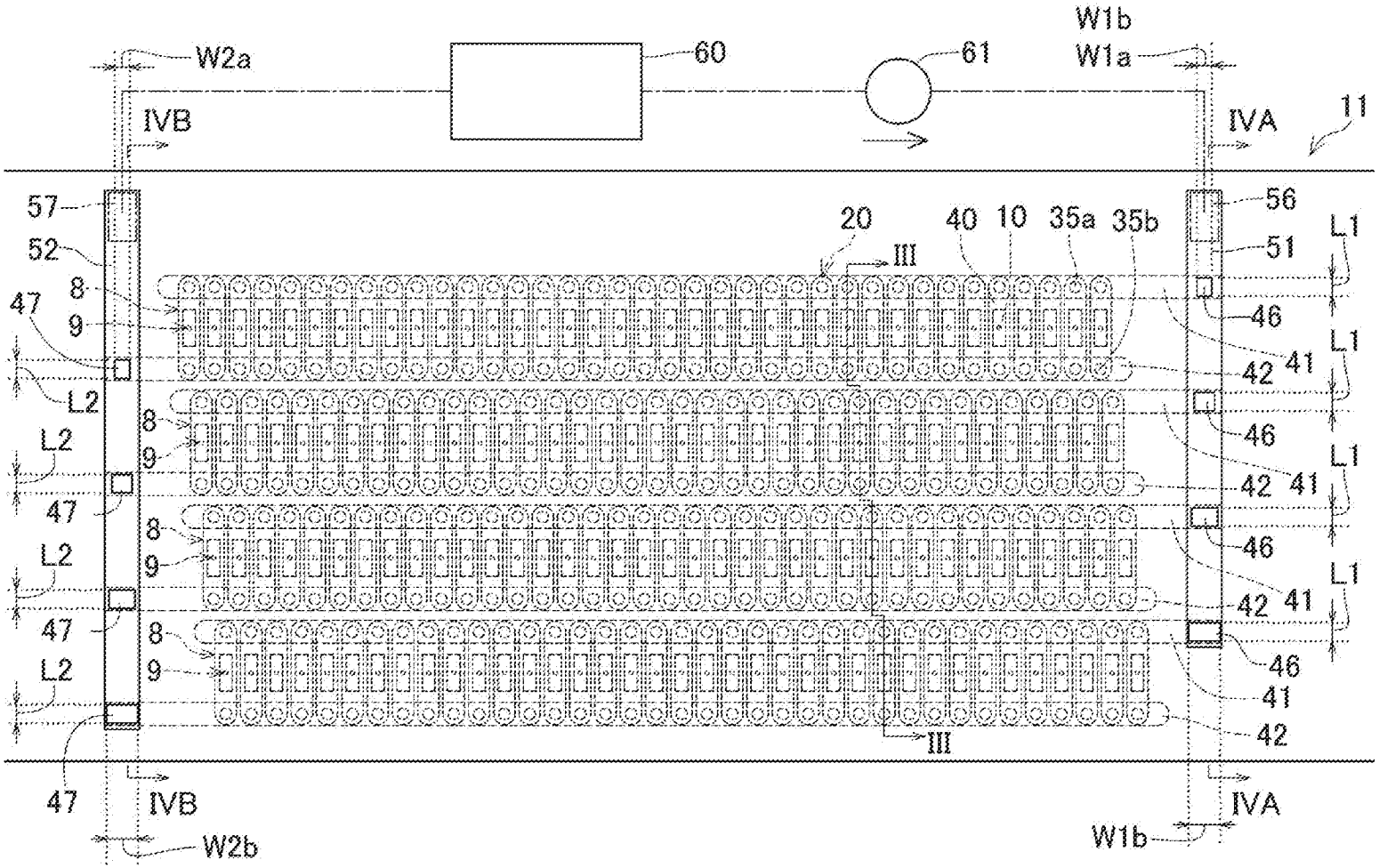
FIG. 2 is a plan view of a head unit.
Figure 3:
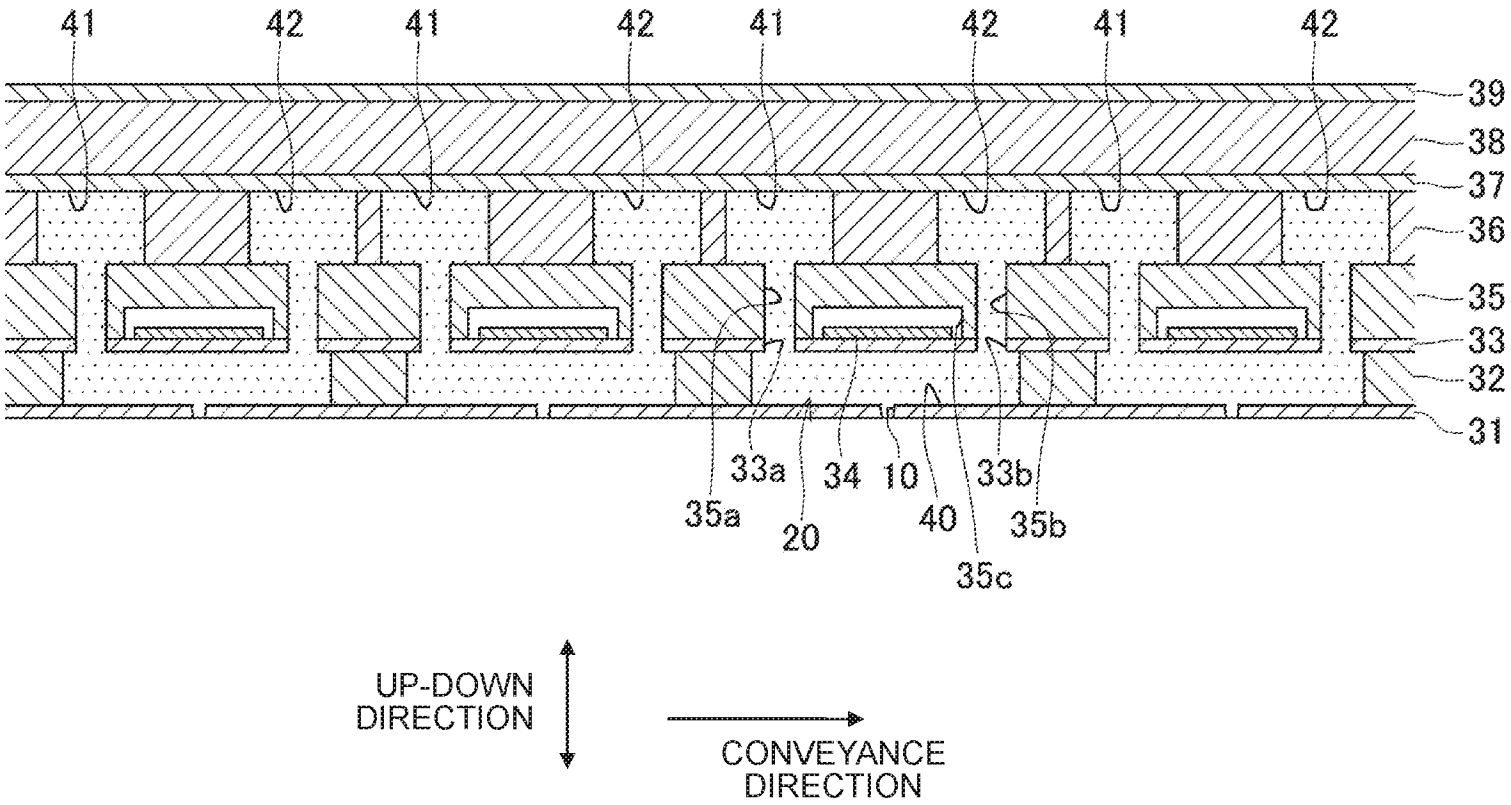
FIG. 3 is a cross-sectional view taken along a line in FIG. 2.

As depicted in FIGS. 1 and 2, the ink-jet head 2 includes four head units 11*a* to 11*d* (a liquid discharge head of the present disclosure) and a holding member 12. Each head unit 11 discharges ink from nozzles 10 formed in a lower surface of the head unit 11. More specifically, the nozzles 10 form four nozzle rows 9 arranged in a conveyance direction (a second direction of the present disclosure) orthogonal to a sheet width direction (a first direction of the present disclosure). Each nozzle row 9 extends in the sheet width direction. The position in the sheet width direction of each nozzle 10 included in one of the nozzle rows 9 adjacent to each other in the conveyance direction is shifted from that of each nozzle 10 included in the other by a length that is one-fourth of an interval in the sheet width direction between the nozzles 10 of each nozzle row 9. In the following, explanation is made while defining the right and the left in the sheet width direction as indicated in FIG. 1. Further, an up-down direction in this embodiment (a third direction of the present disclosure) is defined as indicated in FIG. 3.

The head unit 11*a* is arranged adjacently to the head unit 11*c* in the sheet width direction, and the head unit 11*b* is arranged adjacently to the head unit 11*d* in the sheet width direction. The head units 11*b*, 11*d* are positioned downstream of the head units 11*a*, 11*c* in the conveyance direction. The head units 11*b*, 11*d* are shifted right in the sheet width direction from the head units 11*a*, 11*c*. Thus, in the ink-jet head 2, the nozzles 10 of the four head units 11 are aligned to extend over an entire length in the sheet width direction of a recording sheet P. Namely, the ink-jet head 2 is a line head. Detailed configurations of the head unit 11 are described below.

The holding member 12 is a plate-like rectangular member that is long in the sheet width direction. The four head units 11 are secured to the holding member 12. The holding member 12 has four rectangular through holes 12*a* that respectively correspond to the four head units 11. The nozzles 10 of the head units 11 are exposed to a lower side (recording sheet P side) through the respective through holes 12*a*.

The platen 3, which is disposed below the ink-jet head 2, faces the nozzles 10 of the four head units 11. The platen 3 supports the recording sheet P from below. The conveyance roller 4 is disposed upstream of the ink-jet head 2 and the platen 3 in the conveyance direction. The conveyance roller 5 is disposed downstream of the ink-jet head 2 and the platen 3 in the conveyance direction. The conveyance rollers 4 and 5 convey the recording sheet P in the conveyance direction.

The printer 1 performs recording on the recording sheet P by conveying the recording sheet P in the conveyance direction by use of the conveyance rollers 4 and 5 and discharging ink(s) from the nozzles 10 of the four head units 11.

<Head Unit>

Figure 4A:
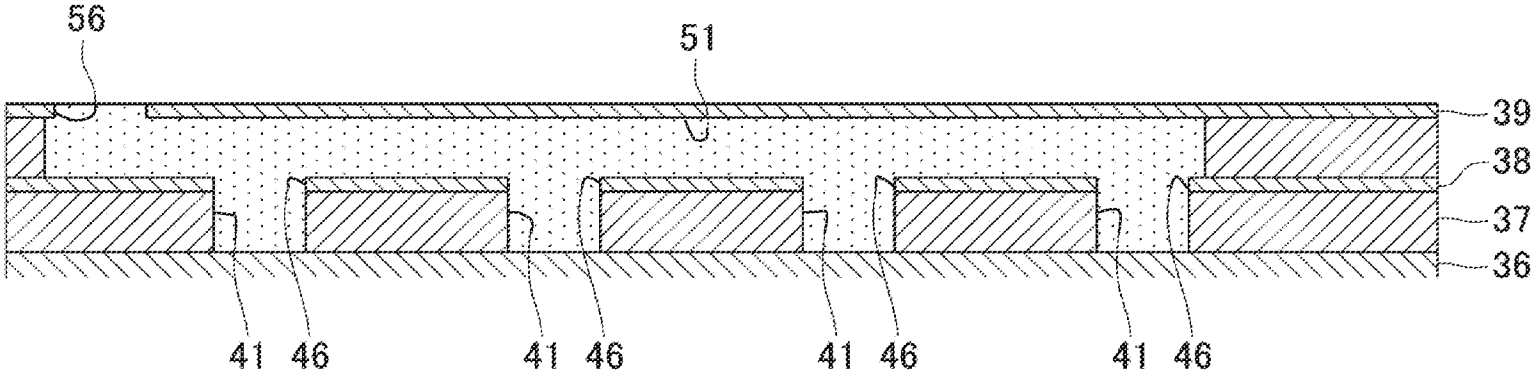
FIG. 4A is a cross-sectional view taken along a line IVA-IVA in FIG. 2.
Figure 4B:
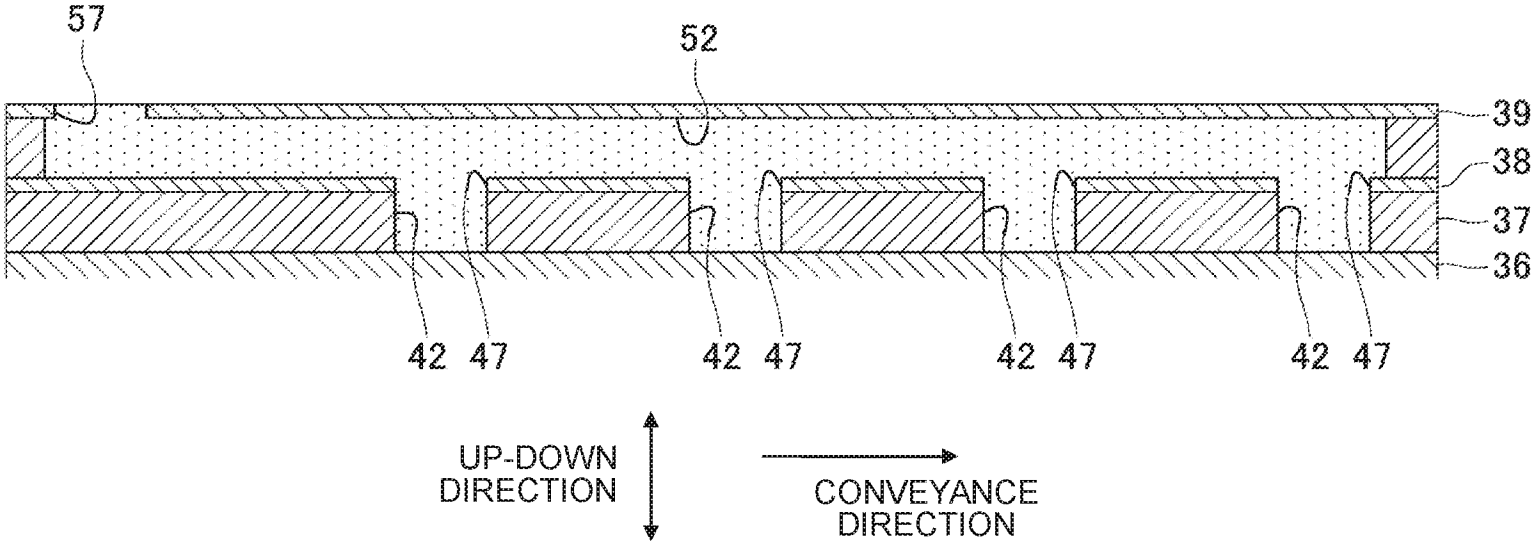
FIG. 4B is a cross-sectional view taken along a line IVB-IVB in FIG. 2.

Subsequently, the head units 11 are explained. As depicted in FIGS. 2 to 4, each head unit 11 includes a nozzle plate 31, a channel substrate 32, a vibration film 33, driving elements 34, a protection substrate 35, and channel plates 36 to 39.

The nozzle plate 31 is made using, for example, a synthetic resin material. The nozzle plate 31 includes the nozzles 10 forming the four nozzle rows 9.

The channel substrate 32, which is made using silicon (Si), is disposed on an upper surface of the nozzle plate 31. The channel substrate 32 includes pressure chambers 40 corresponding to the respective nozzles 10. A center portion in the conveyance direction of each of the pressure chambers 40 overlaps in the up-down direction with the corresponding one of nozzles 10. The channel substrate 32 includes four pressure chamber rows 8 arranged in the conveyance direction. Each pressure chamber row 8 is formed by aligning pressure chambers 40 in the sheet width direction.

The vibration film 33, which is provided at an upper end of the channel substrate 32, covers the pressure chambers 40. The vibration film 33 is made using silicon dioxide ($SiO_2$) or silicon nitride (SiN). The vibration film 33 is formed by oxidizing or nitriding the upper end of the channel substrate 32.

The vibration film 33 has inflow holes 33*a* and outflow holes 33*b* corresponding to the respective pressure chambers 40. Each inflow hole 33*a* overlaps in the up-down direction with an upstream end in the conveyance direction of the corresponding pressure chamber 40. Each outflow hole 33*b* overlaps in the up-down direction with a downstream end in the conveyance direction of the corresponding pressure chamber 40.

The driving elements 34 are provided corresponding to the respective pressure chambers 40. Each driving element 34 is arranged on an upper surface of the vibration film 33 at a portion that overlaps in the up-down direction with the corresponding pressure chamber 40. Each driving element 34 is a piezoelectric element including, for example, a piezoelectric body and an electrode. The configuration of the driving element 34 is similar to that of conventional driving elements, and thus detailed explanation thereof is omitted here.

The protection substrate 35, which is made using silicon (Si), is disposed on an upper surface of the channel substrate 32 provided with the vibration film 33 and the driving elements 34. The protection substrate 35 includes, at portions that overlap in the up-down direction with the inflow holes 33*a*, supply throttle channels 35*a* that pass through the protection substrate 35 in the up-down direction. Further, the protection substrate 35 includes, at portions that overlap in the up-down direction with the outflow holes 33*b*, discharge throttle channels 35*b* that pass through the protection substrate 35 in the up-down direction. In this embodiment, an individual channel 20 is formed by the nozzle 10, the pressure chamber 40, the supply throttle channel 35*a*, and the discharge throttle channel 35*b*.

Further, recesses 35*c* are formed at portions on the lower side of the protection substrate 35 that overlap in the up-down direction with the pressure chambers 40 forming the respective pressure chamber rows 8. The driving elements 34 corresponding to the respective pressure chamber rows 8 are accommodated in the recesses 35*c*.

The channel plate 36 is disposed on an upper surface of the protection substrate 35. The channel plate 36 includes four lower supply manifolds 41 (a first supply channel of the present disclosure) and four lower discharge manifolds 42 (a first discharge channel of the present disclosure).

The four lower supply manifolds 41, which correspond to the four pressure chamber rows 8, are arranged in the conveyance direction. Each of the lower supply manifolds 41 extend in the sheet width direction to extend over the pressure chambers 40 forming the corresponding one of the pressure chamber rows 8. The lower supply manifolds 41 overlap in the up-down direction with the supply throttle channels 35*a* connected to the pressure chambers 40. Further, each of the lower supply manifolds 41 extends rightward in the sheet width direction beyond an area where the corresponding one of the pressure chambers rows 8 is disposed. The length in the conveyance direction of each lower supply manifold 41 is substantially constant independently of the position in the sheet width direction.

The four lower discharge manifolds 42, which correspond to the four pressure chamber rows 8, are arranged in the conveyance direction. Each of the lower discharge manifolds 42 extends in the sheet width direction to extend over the pressure chambers 40 forming the corresponding one of the pressure chamber rows 8. The lower discharge manifolds 42 overlap in the up-down direction with the discharge throttle channels 35*b* connected to the pressure chambers 40. Further, each of the lower discharge manifolds 42 extends leftward in the sheet width direction beyond an area where the corresponding one of the pressure chambers rows 8 is disposed. The length in the conveyance direction of each lower discharge manifold 42 is substantially constant independently of the position in the sheet width direction.

The channel plate 37 is disposed on an upper surface of the channel plate 36. The channel plate 37 has four supply connection openings 46 and four discharge connection openings 47.

The four supply connection openings 46 correspond to the four lower supply manifolds 41. Each of the supply connection openings 46 overlaps in the up-down direction with a right end in the sheet width direction of the corresponding one of the lower supply manifolds 41.

The four supply connection openings 46 are rectangles. The length in the conveyance direction of each supply connection opening 46 is a length L1. The supply connection opening 46 included in the four supply connection openings 46 and disposed at a more downstream side in the conveyance direction is longer in the sheet width direction. In that configuration, the supply connection opening 46 included in the four supply connection openings 46 and disposed at the more downstream side in the conveyance direction (the supply connection opening 46 disposed farther away from a supply opening 56 described below) has a larger cross-sectional area orthogonal to the up-down direction.

Of the four supply connection openings 46, a length W1*a* in the sheet width direction of the supply connection opening 46 disposed at the most upstream side in the conveyance direction and having the shortest length in the sheet width direction is, for example, not less than 0.45 mm and not more than 0.9 mm. The length W1*a* is preferably shorter than the length L1 in the conveyance direction of the supply connection opening 46.

Of the four supply connection openings 46, a length W1*b* in the sheet width direction of the supply connection opening 46 disposed at the most downstream side in the conveyance direction and having the longest length in the sheet width direction is, for example, not less than 0.9 mm and not more than 1.8 mm. The length W1*b* is preferably longer than the length L1 in the conveyance direction of the supply connection opening 46. Further, the length W1*b* is more preferably more than 1.3 times the length L1.

In this embodiment, any two of the four supply connection openings 46 disposed at the more upstream side in the conveyance direction correspond to a first supply connection opening of the present disclosure. Any two of the four supply connection openings 46 disposed at the more downstream side in the conveyance direction correspond to a second supply connection opening of the present disclosure.

The four discharge connection openings 47 correspond to the four lower discharge manifolds 42. Each of the discharge connection openings 47 overlaps in the up-down direction with a left end in the sheet width direction of the corresponding one of the lower discharge manifolds 42.

The four discharge connection openings 47 are rectangles. The length in the conveyance direction of each discharge connection opening 47 is a length L2. The discharge connection opening 47 included in the four discharge connection openings 47 and disposed at the more downstream side in the conveyance direction is longer in the sheet width direction. In that configuration, the discharge connection opening 47 included in the four discharge connection openings 47 and disposed at the more downstream side in the conveyance direction (the discharge connection opening 47 disposed farther away from the supply opening 56 described below) has a larger cross-sectional area orthogonal to the up-down direction.

Of the four discharge connection openings 47, a length W2*a* in the sheet width direction of the discharge connection opening 47 disposed at the most upstream side in the conveyance direction and having the shortest length in the sheet width direction is, for example, not less than 0.45 mm and not more than 0.9 mm. The length W2*a* is preferably shorter than the length L2 in the conveyance direction of the discharge connection opening 47.

Of the four discharge connection openings 47, a length W2*b* in the sheet width direction of the discharge connection opening 47 disposed at the most downstream side in the conveyance direction and having the longest length in the sheet width direction is, for example, not less than 0.9 mm and not more than 1.8 mm. The length W2*b* is preferably longer than the length L2 in the conveyance direction of the discharge connection opening 47. Further, the length W2*b* is more preferably more than 1.3 times the length L2.

In this embodiment, any two of the four discharge connection openings 47 disposed at the more upstream side in the conveyance direction correspond to a first discharge connection opening of the present disclosure. Any two of the four discharge connection openings 47 disposed at the more downstream side in the conveyance direction correspond to a second discharge connection opening of the present disclosure.

The channel plate 38 is disposed on an upper surface of the channel plate 37. The channel plate 38 includes an upper supply manifold 51 (a second supply channel of the present disclosure) and an upper discharge manifold 52 (a second discharge channel of the present disclosure).

The upper supply manifold 51 extends over the four lower supply manifolds 41 in the conveyance direction. The upper supply manifold 51 overlaps in the up-down direction with right ends in the sheet width direction of the four lower supply manifolds 41 and the four supply connection openings 46. In that configuration, the upper supply manifold 51 communicates with the four lower supply manifolds 41 via the four supply connection openings 46. The upper supply manifold 51 has substantially the same length at any positions in the sheet width direction.

The upper discharge manifold 52 extends over the four lower discharge manifolds 42 in the conveyance direction. The upper discharge manifold 52 overlaps in the up-down direction with left ends in the sheet width direction of the four lower discharge manifolds 42 and the four discharge connection openings 47. In that configuration, the upper discharge manifold 52 communicates with the four lower discharge manifolds 42 via the four discharge connection openings 47. The upper discharge manifold 52 has substantially the same length at any positions in the sheet width direction.

The channel plate 39 is disposed on an upper surface of the channel plate 38. The channel plate 39 has a supply opening 56 and a discharge opening 57. The supply opening 56 overlaps in the up-down direction with an upstream end in the conveyance direction of the upper supply manifold 51. The discharge opening 57 overlaps in the up-down direction with an upstream end in the conveyance direction of the upper discharge manifold 52.

The supply opening 56 and the discharge opening 57 are connected to the same ink tank 60 via channels (not depicted). A pump 61 is provided in a channel connecting between the supply port 56 and the ink tank 60. The pump 61 pumps or feeds ink from an ink tank 60 side toward a supply opening 56 side. Namely, the pump 61 pumps or feeds ink into the upper supply manifold 51.

Ink pumped by the pump 61 flows into the head unit 11 through the supply opening 56. Ink in the head unit 11 flows through the upper supply manifold 51, the four supply connection openings 46, and the four lower supply manifolds 41, and then flows into the individual channels 20 through the supply throttle channels 35*a*. Ink in the individual channels 20 flows into the four lower discharge manifolds 42 through the discharge throttle channels 35*b* and is discharged from the discharge opening 57 after flowing through the four lower discharge manifolds 42, the four discharge connection openings 47, and the upper discharge manifold 52. Then, ink returns to the ink tank 60. In this embodiment, ink circulates between the ink tank 60 and the head unit 11 as described above.

<Effect>

Unlike this embodiment, it is assumed that the cross-sectional areas orthogonal to the up-down direction of the four supply connection openings 46 are identical to each other and that the cross-sectional areas orthogonal to the up-down direction of the four discharge connection openings 47 are identical to each other. In that case, the four supply connection openings 46 have substantially the same channel resistance, and the four discharge connection openings 47 have substantially the same channel resistance.

In that configuration, when the pump 61 connected to the supply opening 56 pumps ink toward the upper supply manifold 51, ink is not likely to flow from the upper supply manifold 51 to the lower supply manifold 41 farther away from the supply port 56 and disposed at the more downstream side in the conveyance direction. The four lower supply manifolds 41 may thus have great variation in flowability of ink from the upper supply manifold 51. Similarly, ink in the lower discharge manifold 42 farther away from the supply opening 56 and disposed at the more downstream side in the conveyance direction is not likely to flow into the upper discharge manifold 52. The four lower discharge manifolds 42 may thus have great variation in flowability of ink into the upper discharge manifold 52.

In order to solve that problem, in this embodiment, the supply opening 56 is connected to the upstream end in the conveyance direction of the upper supply manifold 51, and the cross-sectional area orthogonal to the up-down direction of the supply connection opening 46 farther away from the supply opening 56 in the conveyance direction and disposed at the more downstream side in the conveyance direction is larger. This makes the channel resistance of the supply connection opening 46 farther away from the supply opening 56 and disposed at the more downstream side in the conveyance direction smaller. The four lower supply manifolds 41 can thus have uniform flowability of ink from the upper supply manifold 51.

In this embodiment, the discharge connection opening 47 farther away from the supply opening 56 in the conveyance direction and disposed at the more downstream side in the conveyance direction has a larger cross-sectional area orthogonal to the up-down direction. This makes the channel resistance of the discharge connection opening 47 farther away from the supply opening 56 and disposed at the more downstream side in the conveyance direction smaller. The four lower discharge manifolds 42 can thus have uniform flowability of ink into the upper discharge manifold 52.

Accordingly, the individual channels 20 can have a uniform ink circulation amount.

In this embodiment, the four supply connection openings 46 have the same length in the conveyance direction, which is the length L1. The supply connection opening 46 disposed at the more downstream side in the conveyance direction has a longer length in the sheet width direction. In that configuration, the supply connection opening 46 disposed at the more downstream side in the conveyance direction has a larger cross-sectional area orthogonal to the up-down direction.

In this embodiment, the length W1*b* in the sheet width direction of the supply connection opening 46 included in the four supply connection openings 46, having the longest length in the sheet width direction, and disposed at the most downstream side in the conveyance direction is longer than the length L1 in the conveyance direction of each supply connection opening 46 (preferably, more than 1.3 times the length L1). In that configuration, the cross-sectional area orthogonal to the up-down direction of the supply connection opening 46 disposed at the most downstream side in the conveyance direction can be sufficiently larger than the cross-sectional areas of the remaining other supply connection openings 46.

In this embodiment, the length W1*a* in the sheet width direction of the supply connection opening 46 included in the four supply connection openings 46, having the shortest length in the sheet width direction, and disposed at the most upstream side in the conveyance direction is shorter than the length L1 in the conveyance direction of each supply connection opening 46. In that configuration, the cross-sectional area orthogonal to the up-down direction of the supply connection opening 46 disposed at the most upstream side in the conveyance direction can be sufficiently smaller than the cross-sectional areas of the remaining other supply connection openings 46.

In this embodiment, the four discharge connection openings 47 have the same length in the conveyance direction, which is the length L2. The discharge connection opening 47 disposed at the more downstream side in the conveyance direction has a longer length in the sheet width direction. In that configuration, the discharge connection opening 47 disposed at the more downstream side in the conveyance direction has a larger cross-sectional area orthogonal to the up-down direction.

In this embodiment, the length W2*b* in the sheet width direction of the discharge connection opening 47 included in the four discharge connection openings 47, having the longest length in the sheet width direction, and dispossed at the most downstream side in the conveyance direction is longer than the length L2 in the conveyance direction of each discharge connection opening 47 (preferably, more than 1.3 times the length L2). In that configuration, the cross-sectional area orthogonal to the up-down direction of the discharge connection opening 47 disposed at the most downstream side in the conveyance direction can be sufficiently larger than the cross-sectional areas of the remaining other discharge connection openings 47.

In this embodiment, the length W2*a* in the sheet width direction of the discharge connection opening 47 included in the four discharge connection openings 47, having the shortest length in the sheet width direction, and disposed at the most upstream side in the conveyance direction is shorter than the length L2 in the conveyance direction of each discharge connection opening 47. In that configuration, the cross-sectional area orthogonal to the up-down direction of the discharge connection opening 47 disposed at the most upstream side in the conveyance direction can be sufficiently smaller than the cross-sectional areas of the remaining other discharge connection openings 47.

MODIFIED EXAMPLES

Although the embodiment of the present disclosure is explained above, the present disclosure is not limited to the above embodiment, and a variety of modifications are possible without departing from the claims.

In the above embodiment, the length W1*b* in the sheet width direction of the supply connection opening 46 included in the four supply connection openings 46, having the longest length in the sheet width direction, and disposed at the most downstream side in the conveyance direction is not less than 0.9 mm and not more than 1.8 mm. The present disclosure, however, is not limited thereto. The length W1*b* may be less than 0.9 mm or more than 1.8 mm. Further, provided that the length W1*b* is longer than the lengths in the sheet width direction of the remaining other supply connection openings 46, the length W1*b* may be less than 1.3 times the length L1 in the conveyance direction of the supply connection opening 46, or the length W1*b* may be less than the length L1 in the conveyance direction of the supply connection opening 46.

In the above embodiment, the length W1*a* in the sheet width direction of the supply connection opening 46 included in the four supply connection openings 46, having the shortest length in the sheet width direction, and disposed at the most upstream side in the conveyance direction is not less than 0.45 mm and not more than 0.9 mm. The present disclosure, however, is not limited thereto. The length W1*a* may be less than 0.45 mm or more than 0.9 mm. Further, provided that the length W1*a* is shorter than the lengths in the sheet width direction of the remaining other supply connection openings 46, the length W1*a* may be not less than the length L1 in the conveyance direction of the supply connection opening 46.

In the above embodiment, the length W2*b* in the sheet width direction of the discharge connection opening 47 included in the four discharge connection openings 47, having the longest length in the sheet width direction, and disposed at the most downstream side in the conveyance direction is not less than 0.9 mm and not more than 1.8 mm. The present disclosure, however, is not limited thereto. The length W2*b* may be less than 0.9 mm or more than 1.8 mm. Further, provided that the length W2*b* is longer than the lengths in the sheet width direction of the remaining other discharge connection openings 47, the length W2*b* may be less than 1.3 times the length L2 in the conveyance direction of the discharge connection opening 47, or the length W2*b* may be less than the length L2 in the conveyance direction of the discharge connection opening 47.

In the above embodiment, the length W2*a* in the sheet width direction of the discharge connection opening 47 included in the four discharge connection openings 47, having the shortest length in the sheet width direction, and disposed at the most upstream side in the conveyance direction is not less than 0.45 mm and not more than 0.9 mm. The present disclosure, however, is not limited thereto. The length W2*a* may be less than 0.45 mm and more than 0.9 mm. Further, provided that the length W2*a* is shorter than the lengths in the sheet width direction of the remaining other discharge connection openings 47, the length W2*a* may be not less than the length L2 in the conveyance direction of the discharge connection opening 47.

In the above embodiment, the four supply connection openings 46 are rectangles, have the same length (the length L1) in the conveyance direction, and have different lengths in the sheet width direction. This makes the cross-sectional areas orthogonal to the up-down direction of the four supply connection openings 46 different from each other. The present disclosure, however, is not limited thereto.

For example, the four rectangular supply connection openings 46 may have the same length in the sheet width direction and different lengths in the conveyance direction. Or, the four supply connection openings 46 may have different lengths in the sheet width direction and the conveyance direction. In those cases, the cross-sectional areas orthogonal to the up-down direction of the four supply connection openings 46 can be different from each other.

In the above embodiment, the four discharge connection openings 47 are rectangles, have the same length (the length L2) in the conveyance direction, and have different lengths in the sheet width direction. This makes the cross-sectional areas orthogonal to the up-down direction of the four discharge connection openings 47 different from each other. The present disclosure, however, is not limited thereto.

For example, the four rectangular discharge connection openings 47 may have the same length in the sheet width direction and different lengths in the conveyance direction. Or, the four discharge connection openings 47 may have different lengths in the sheet width direction and the conveyance direction. In those cases, the cross-sectional areas orthogonal to the up-down direction of the four discharge connection openings 47 can be different from each other.

Figure 5:
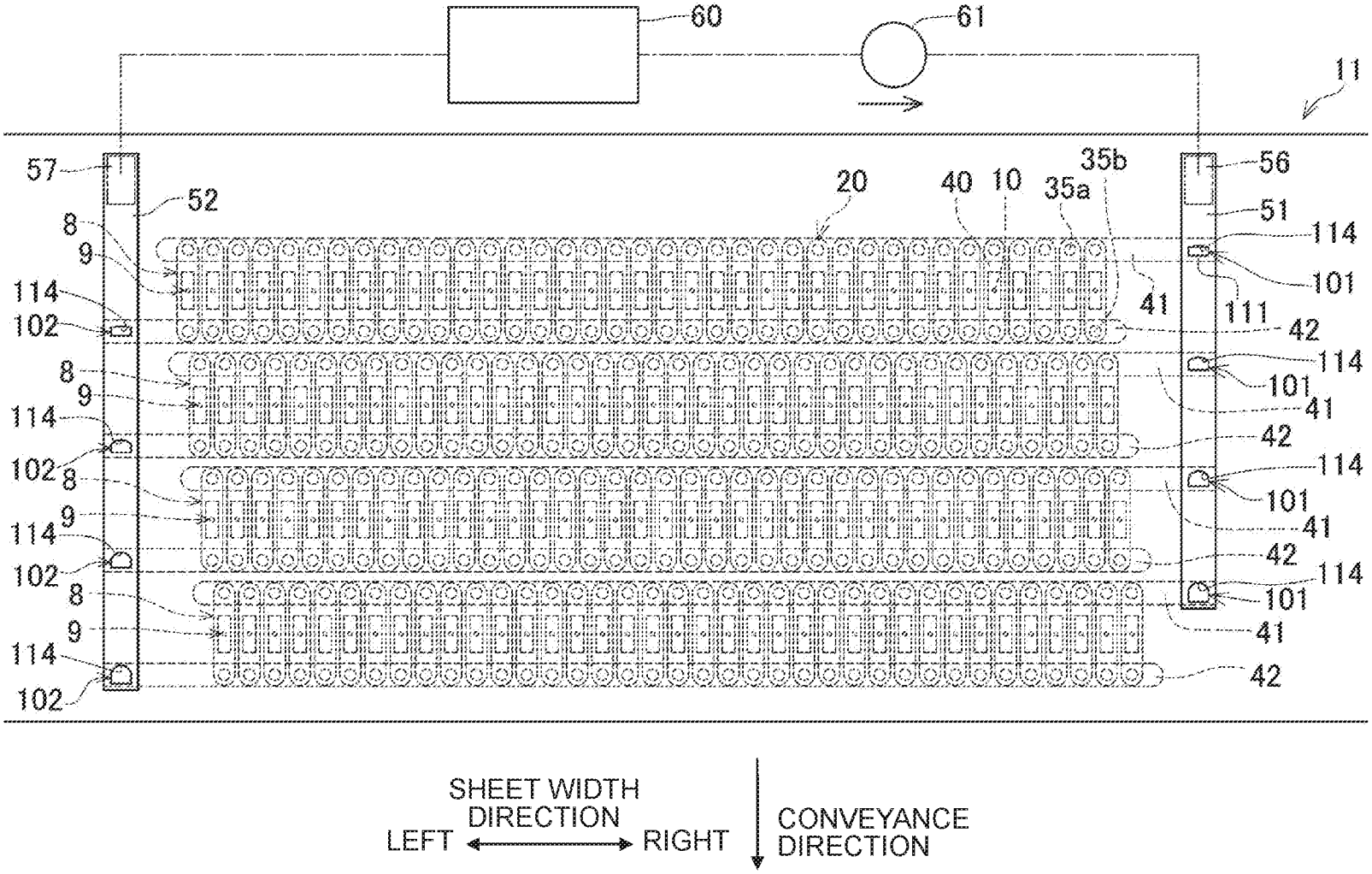
FIG. 5 is a plan view according to a first modified example, and FIG. 5 corresponds to FIG. 3.
Figure 6A:
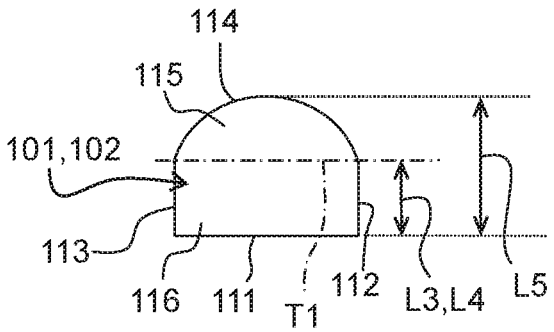
FIG. 6A illustrates a supply connection opening and a discharge connection opening according to the first modified example.

The shapes of the supply connection openings 46 and the discharge connection openings 47 are not limited to the rectangles. For example, in a first modified example as depicted in FIGS. 5 and 6A, inner wall surfaces of a supply connection opening 101 and a discharge connection opening 102 are provided with flat surfaces 111 to 113 and a curved surface 114. In the first modified example, the flat surfaces 111, 112, and 113 of the supply connection opening 101 respectively correspond to a first surface, a second surface, and a third surface of the present disclosure. The flat surfaces 111, 112, and 113 of the discharge connection opening 102 respectively correspond to a fourth surface, a fifth surface, and a sixth surface of the present disclosure. The curved surface 114 of the supply connection opening 101 corresponds to a first curved surface of the present disclosure, and the curved surface 114 of the discharge connection opening 102 corresponds to a second curved surface of the present disclosure.

The flat surface 111 is parallel to the sheet width direction. The flat surfaces 112 and 113 are parallel to the conveyance direction. A downstream end in the conveyance direction of the flat surface 112 is connected to a right end in the sheet width direction of the flat surface 111. A downstream end in the conveyance direction of the flat surface 113 is connected to a left end in the sheet width direction of the flat surface 111. A length L3 in the conveyance direction of the flat surface 112 is substantially the same as a length L4 in the conveyance direction of the flat surface 113. The curved surface 114 connects an upstream end in the conveyance direction of the flat surface 112 and an upstream end in the conveyance direction of the flat surface 113. The curved surface 114 curves to be convex upstream in the conveyance direction (toward the opposite side of the flat surface 111).

In the first modified example, a length L5 between the flat surface 111 and part of the curved surface 114 farthest from the flat surface 111 is longer than a length (the length L3 in the conveyance direction of the flat surface 112) between the flat surface 111 and the upstream end in the conveyance direction of the flat surface 112 and a length (the length L4 in the conveyance direction of the flat surface 113) between the flat surface 111 and the upstream end in the conveyance direction of the flat surface 113.

In the four supply connection openings 101 of the first modified example, the flat surfaces 111 have the same length in the sheet width direction, the flat surfaces 112 have the same length in the conveyance direction, and the flat surfaces 113 have the same length in the conveyance direction. The supply connection opening 101 disposed at the more downstream side in the conveyance direction has a larger curvature of the curved surface 114. In that configuration, the supply connection opening 101 disposed at the more downstream side in the conveyance direction has a longer length L5 in the conveyance direction between the flat surface 111 and the part of the curved surface 114 farthest from the flat surface 111.

In the above configuration, the supply connection opening 101 disposed at the more downstream side in the conveyance direction has a larger cross-sectional area orthogonal to the up-down direction of a convex portion 115 (a first convex portion of the present disclosure). The convex portion 115 is convex upstream in the conveyance direction beyond a straight line T1 passing through a connection portion between the flat surface 112 and the curved surface 114 and a connection portion between the flat surface 113 and the curved surface 114.

Each supply connection opening 101 is formed by the convex portion 115 and a rectangular portion 116 surrounded by the flat surfaces 111 to 113 and the straight line T1. The four supply connection openings 101 have the same cross-sectional area orthogonal to the up-down direction of the rectangular portion 116. As described above, the supply connection opening 101 disposed at the more downstream side in the conveyance direction has a larger cross-sectional area orthogonal to the up-down direction of the convex portion 115. Thus, the supply connection opening 101 disposed at the more downstream side in the conveyance direction has a larger cross-sectional area orthogonal to the up-down direction.

In the four discharge connection openings 102 of the first modified example, the flat surfaces 111 have the same length in the sheet width direction, the flat surfaces 112 have the same length in the conveyance direction, and the flat surfaces 113 have the same length in the conveyance direction. The discharge connection opening 102 disposed at the more downstream side in the conveyance direction has a larger curvature of the curved surface 114. In that configuration, the discharge connection opening 102 included in the four discharge connection openings 102 and disposed at the more downstream side in the conveyance direction has a longer length L5 in the conveyance direction between the flat surface 111 and the part of the curved surface 114 farthest from the flat surface 111.

In the above configuration, the discharge connection opening 102 disposed at the more downstream side in the conveyance direction has a larger cross-sectional area orthogonal to the up-down direction of the convex portion 115 (a second convex portion of the present disclosure). The discharge connection opening 102 disposed at the more downstream side in the conveyance direction thus has a larger cross-sectional area orthogonal to the up-down direction.

In the supply connection openings 101 and the discharge connection openings 102 of the first modified example, the length in the conveyance direction of the flat surface 112 is the same as the length in the conveyance direction of the flat surface 113. The present disclosure, however, is not limited thereto.

Figure 6B:
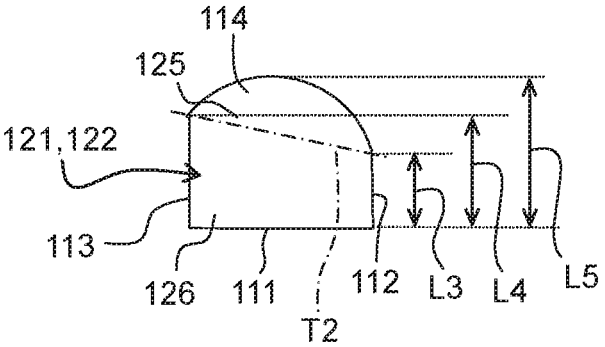
FIG. 6B illustrates a supply connection opening and a discharge connection opening according to a second modified example.

As depicted in FIG. 6B, in a supply connection opening 121 and a discharge connection opening 122 of a second modified example, the length L3 in the conveyance direction of the flat surface 112 is shorter than the length L4 in the conveyance direction of the flat surface 113. Also in the second modified example, the length L5 between the flat surface 111 and the part of the curved surface 114 farthest from the flat surface 111 is longer than the length L3 of the flat surface 112 and the length L4 of the flat surface 113. The supply connection opening 121 and the discharge connection opening 122 disposed at the more downstream side in the conveyance direction each have a longer length L5.

In the above configuration, the supply connection opening 121 and the discharge connection opening 122 disposed at the more downstream side in the conveyance direction each have a larger cross-sectional area orthogonal to the up-down direction of a convex portion 125. The convex portion 125 is convex upstream in the conveyance direction beyond a straight line T2 passing through a connection portion between the flat surface 112 and the curved surface 114 and a connection portion between the flat surface 113 and the curved surface 114.

In the second modified example, the four supply connection openings 121 have the same cross-sectional area orthogonal to the up-down direction of a rectangular portion 126 surrounded by the flat surfaces 111 to 113 and the straight line T2. The four discharge connection openings 122 have the same cross-sectional area orthogonal to the up-down direction of the rectangular portion 126. Thus, the supply connection opening 121 and the discharge connection opening 122 disposed at the more downstream side in the conveyance direction each have a larger cross-sectional area orthogonal to the up-down direction.

Figure 6C:
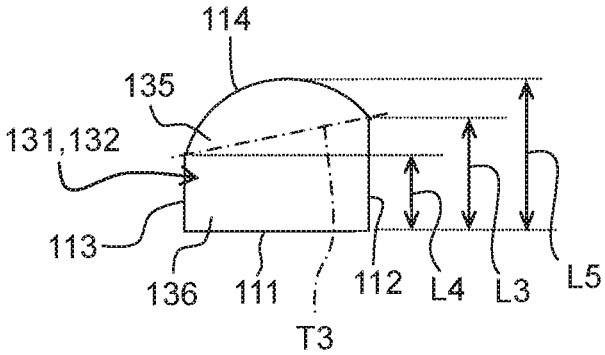
FIG. 6C illustrates a supply connection opening and a discharge connection opening according to a third modified example.

As depicted in FIG. 6C, in a supply connection opening 131 and a discharge connection opening 132 of a third modified example, the length L3 in the conveyance direction of the flat surface 112 is longer than the length L4 in the conveyance direction of the flat surface 113. Also in the third modified example, the length L5 between the flat surface 111 and the part of the curved surface 114 farthest from the flat surface 111 is longer than the length L3 of the flat surface 112 and the length L4 of the flat surface 113. The supply connection opening 131 and the discharge connection opening 132 disposed at the more downstream side in the conveyance direction each have a longer length L5.

In the above configuration, the supply connection opening 131 and the discharge connection opening 132 disposed at the more downstream side in the conveyance direction each have a larger cross-sectional area orthogonal to the up-down direction of a convex portion 135. The convex portion 135 is convex upstream in the conveyance direction beyond a straight line T3 passing through a connection portion between the flat surface 112 and the curved surface 114 and a connection portion between the flat surface 113 and the curved surface 114.

In the third modified example, the four supply connection openings 131 have the same cross-sectional area orthogonal to the up-down direction of a rectangular portion 136 surrounded by the flat surfaces 111 to 113 and the straight line T3. The four discharge connection openings 132 have the same cross-sectional area orthogonal to the up-down direction of the rectangular portion 136. The supply connection opening 131 and the discharge connection opening 132 disposed at the more downstream side in the conveyance direction each have a larger cross-sectional area orthogonal to the up-down direction.

In the first to third modified examples, the entirety of the curved surface 114 curves to be convex toward the opposite side of the flat surface 111. The present disclosure, however, is not limited thereto.

Figure 6D:
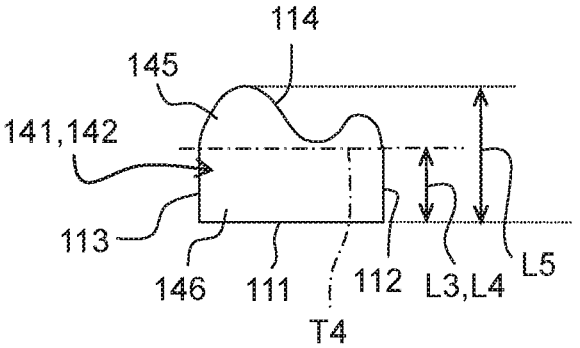
FIG. 6D illustrates a supply connection opening and a discharge connection opening according to a fourth modified example.
Figure 6D:
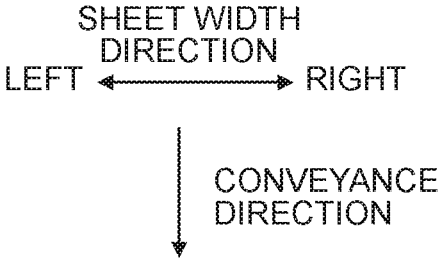

As depicted in FIG. 6D, in a supply connection opening 141 and a discharge connection opening 142 of a fourth modified example, part of the curved surface 144 including a connection portion with the flat surface 112 and part of the curved surface 144 including a connection portion with the flat surface 113 curve to be convex upstream in the conveyance direction (the opposite side of the flat surface 111). Part of the curved surface 144, which is positioned between the above two parts that are convex upstream, curves to be convex downstream in the conveyance direction (the flat surface 111 side). In the fourth modified example, the length L5 between the flat surface 111 and the part of the curved surface 144 farthest from the flat surface 111 in the conveyance direction is longer than length L3 of the flat surface 112 and the length L4 of the flat surface 113. The supply connection opening 141 and the discharge connection opening 142 disposed at the more downstream side in the conveyance direction each have a longer length L5.

In the above configuration, the supply connection opening 141 and the discharge connection opening 142 disposed at the more downstream side in the conveyance direction each have a larger cross-sectional area orthogonal to the up-down direction of a convex portion 145. The convex portion 145 is convex upstream in the conveyance direction beyond a straight line T4 passing through the connection portion between the flat surface 112 and the curved surface 144 and the connection portion between the flat surface 113 and the curved surface 144.

In the fourth modified example, the four supply connection openings 141 have the same cross-sectional area orthogonal to the up-down direction of a rectangular portion 146 surrounded by the flat surfaces 111 to 113 and the straight line T4. The four discharge connection openings 142 have the same cross-sectional area orthogonal to the up-down direction of the rectangular portion 146. Thus, the supply connection opening 141 and the discharge connection opening 142 disposed at the more downstream side in the conveyance direction each have a larger cross-sectional area orthogonal to the up-down direction.

In FIG. 6D, the length L3 of the flat surface 112 is the same as the length L4 of the flat surface 113, similar to the first modified example. In the fourth modified example, however, the length L3 of the flat surface 112 may be different from the length L4 of the flat surface 113, similar to the second modified example or the third modified example.

In the above embodiment, the supply opening 56 and the discharge opening 57 are respectively connected to the ends on the same side in the conveyance direction of the upper supply manifold 51 and the upper discharge manifold 52. The present disclosure, however, is not limited thereto.

Figure 7:
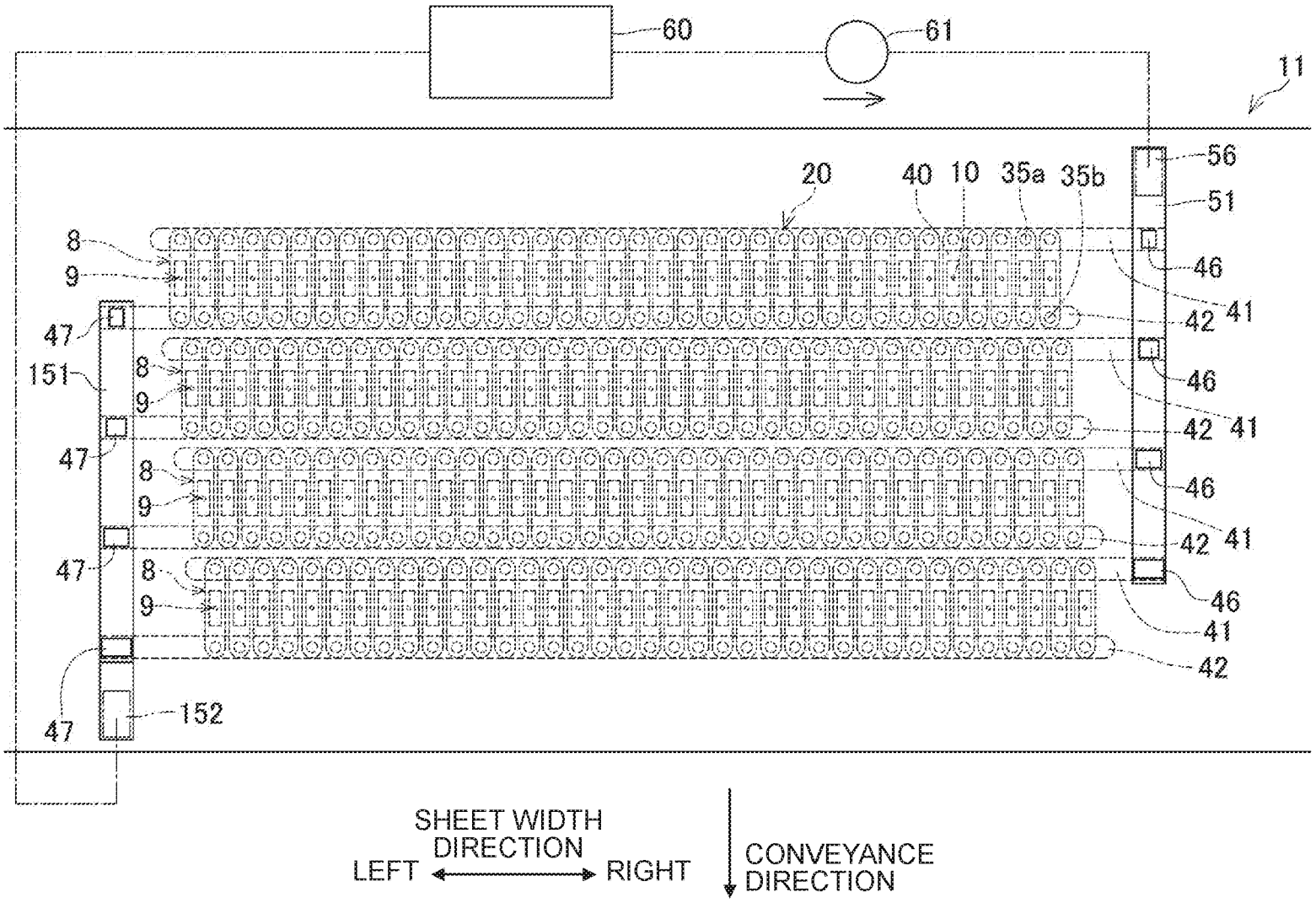
FIG. 7 is a plan view according to a fifth modified example, and FIG. 7 corresponds to FIG. 3.

In a fifth modified example, an upper discharge manifold 151 extends toward the downstream side in the conveyance direction beyond the connection portions with the four discharge connection openings 47, as depicted in FIG. 7. The discharge opening 152 overlaps in the up-down direction with a downstream end in the conveyance direction of the upper discharge manifold 151.

Also in that configuration, the discharge connection opening 47 farther away from the supply opening 56 and disposed at the more downstream side in the conveyance direction has a larger cross-sectional area orthogonal to the up-down direction, similar to the above embodiment. This allows the lower discharge manifolds 42 to have uniform flowability of ink into the upper discharge manifold 151.

In the above embodiment, the pump 61, which pumps ink to the upper supply manifold 51, is provided in the channel connecting the supply port 56 and the ink tank 60. The present disclosure, however, is not limited thereto.

Figure 8:
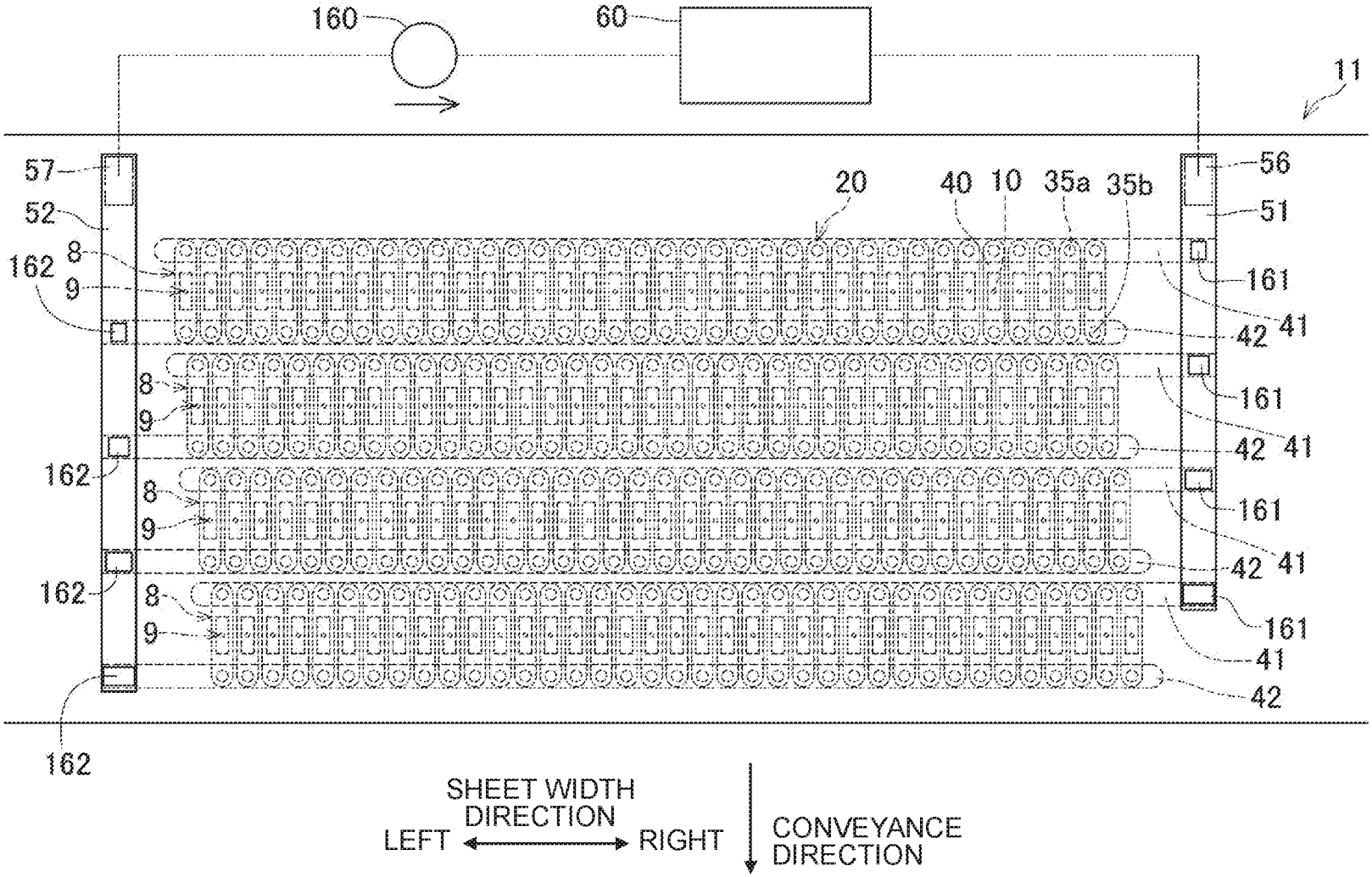
FIG. 8 is a plan view according to a sixth modified example, and FIG. 8 corresponds to FIG. 3.

In a sixed modified example, as depicted in FIG. 8, no pump is provided in the channel connecting the supply port 56 and the ink tank 60. A pump 160 is provided in a channel connecting the discharge opening 57 and the ink tank 60. The pump 160 pumps ink from the discharge opening 57 side toward the ink tank 60 side. Namely, the pump 160 pumps ink in a direction in which ink is discharged from the upper discharge manifold 52.

In the sixth modified example, the supply connection opening 161 farther away from the discharge opening 57 in the conveyance direction and disposed at the more downstream side in the conveyance direction has a longer length in the sheet width direction. In that configuration, the supply connection opening 161 disposed at the more downstream side in the conveyance direction has a larger cross-sectional area orthogonal to the up-down direction. Further, the discharge connection opening 162 farther away from the discharge opening 57 in the conveyance direction and disposed at the more downstream side in the conveyance direction has a longer length in the sheet width direction. In that configuration, the discharge connection opening 162 disposed at the more downstream side in the conveyance direction has a larger cross-sectional area orthogonal to the up-down direction.

In the sixth modified example, any two of the four supply connection openings 161 disposed at the more upstream side in the conveyance direction correspond to a first supply connection opening of the present disclosure, and any two of the four supply connection openings 161 disposed at the more downstream side in the conveyance direction correspond to a second supply connection opening of the present disclosure. Further, any two of the four discharge connection openings 162 disposed at the more upstream side in the conveyance direction correspond to a first discharge connection opening of the present disclosure, and any two of the four discharge connection openings 162 disposed at the more downstream side in the conveyance direction correspond to a second discharge connection opening of the present disclosure.

Unlike the sixth modified example, it is assumed that the four supply connection openings 161 have the same cross-sectional area orthogonal to the up-down direction and that the four discharge connection openings 162 have the same cross-sectional area orthogonal to the up-down direction. In that case, the four supply connection openings 161 have substantially the same channel resistance, and the four discharge connection openings 162 have substantially the same channel resistance.

In the above configuration, when the pump 160 connected to the discharge opening 57 pumps ink in the direction in which ink is discharged from the upper discharge manifold 52, ink is not likely to flow from the upper supply manifold 51 to the lower supply manifold 41 farther away from the discharge opening 57 and disposed at the more downstream side in the conveyance direction. The four lower supply manifolds 41 may thus have great variation in flowability of ink from the upper supply manifold 51. Further, ink is not likely to flow into the upper discharge manifold 52 from the lower discharge manifold 42 farther away from the discharge opening 57 and disposed at the more downstream side in the conveyance direction. The lower discharge manifolds 42 may thus have great variation in flowability of ink to the upper discharge manifold 52.

In the sixth modified example, the discharge opening 57 is connected to the upstream end in the conveyance direction of the upper discharge manifold 52, and the supply connection opening 161 farther away from the discharge opening 57 in the conveyance direction and disposed at the more downstream side in the conveyance direction has a larger cross-sectional area orthogonal to the up-down direction. This allows the supply connection opening 161 farther away from the discharge opening 57 and disposed at the more downstream side in the conveyance direction to have a smaller channel resistance. The lower supply manifolds 41 can thus have uniform flowability of ink from the upper supply manifold 51.

In the sixth modified example, the discharge connection opening 162 farther away from the discharge opening 57 in the conveyance direction and disposed at the more downstream side in the conveyance direction has a larger cross-sectional area orthogonal to the up-down direction. This allows the discharge connection opening 162 farther away from the discharge opening 57 and disposed at the more downstream side in the conveyance direction to have a smaller channel resistance. The lower discharge manifolds 42 can thus have uniform flowability of ink into the upper discharge manifold 52.

Accordingly, the individual channels 20 can have a uniform ink circulation amount.

Figure 9:
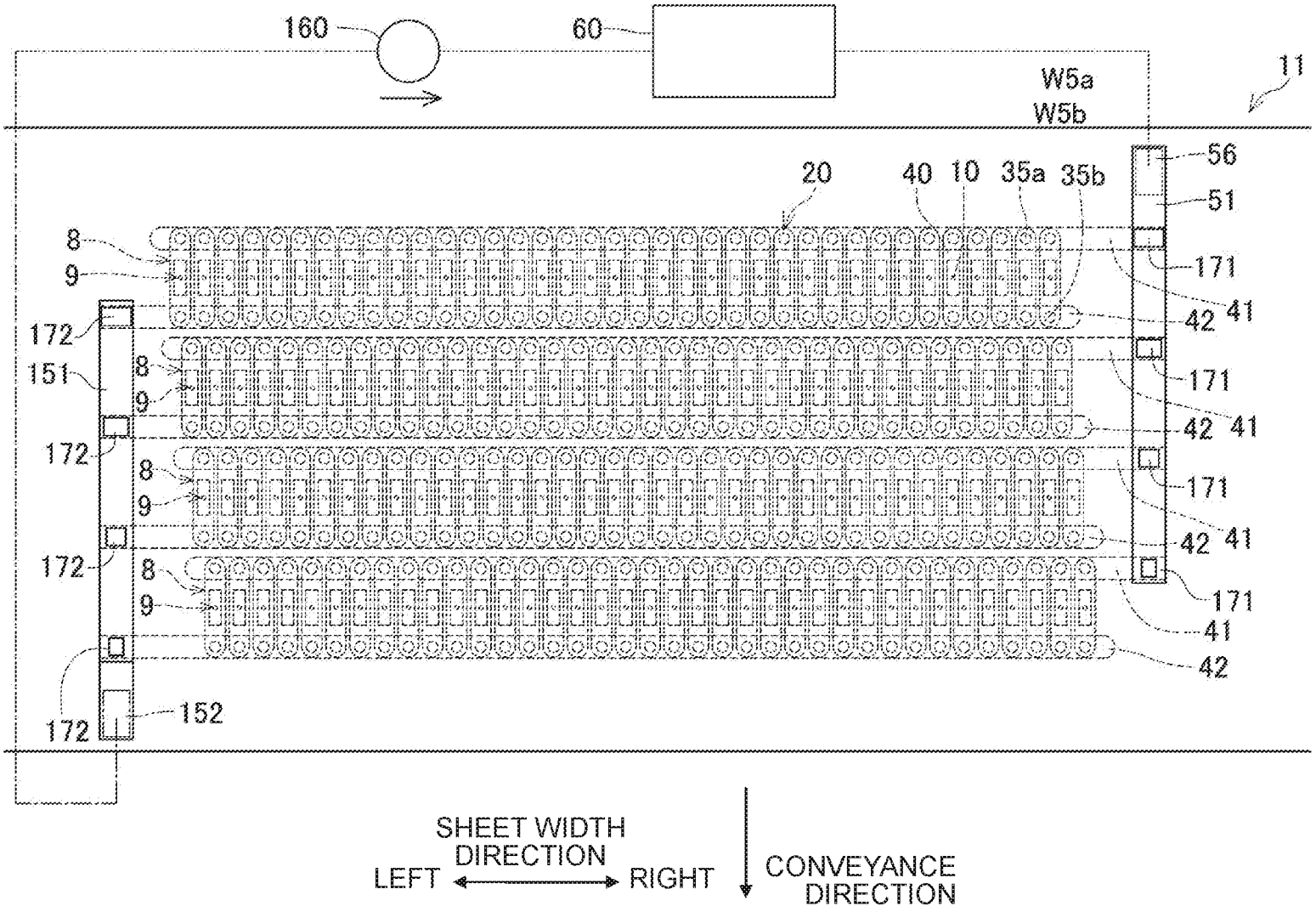
FIG. 9 is a plan view according to a seventh modified example, and FIG. 9 corresponds to FIG. 3.

In a seventh modified example, as depicted in FIG. 9, the discharge opening 152 overlaps in the up-down direction with the downstream end in the conveyance direction of the upper discharge manifold 151, similar to the fifth modified example. Further, in the seventh modified example, no pump is provided in the channel connecting the supply port 56 and the ink tank 60, and the pump 160 is provided in a channel connecting the discharge opening 152 and the ink tank 60, similar to the sixth modified example.

In the seventh modified example, a supply connection opening 171 farther away from the discharge opening 152 in the conveyance direction and disposed at the more upstream side in the conveyance direction has a longer length in the sheet width direction. In that configuration, the supply connection opening 171 disposed at the more upstream side in the conveyance direction has a larger cross-sectional area orthogonal to the up-down direction. Further, a discharge connection opening 172 farther away from the discharge opening 152 in the conveyance direction and disposed at the more upstream side in the conveyance direction has a longer length in the sheet width direction. In that configuration, the discharge connection opening 172 disposed at the more upstream side in the conveyance direction has a larger cross-sectional area orthogonal to the up-down direction.

In the seventh modified example, any two of the four supply connection openings 171 disposed at the more downstream side in the conveyance direction correspond to the first supply connection opening of the present disclosure. Any two of the four supply connection openings 171 disposed at the more upstream side in the conveyance direction correspond to the second supply connection opening of the present disclosure. Further, any two of the four discharge connection openings 172 disposed at the more downstream side in the conveyance direction correspond to the first discharge connection opening of the present disclosure. Any two of the four discharge connection openings 172 disposed at the more upstream side in the conveyance direction correspond to the second discharge connection opening of the present disclosure.

In the seventh modified example, the supply connection opening 171 farther away from the discharge opening 152 in the conveyance direction and disposed at the more upstream side in the conveyance direction has a larger cross-sectional area orthogonal to the up-down direction. This allows the supply connection opening 171 farther away from the discharge opening 152 and disposed at the more upstream side in the conveyance direction to have a smaller channel resistance. The lower supply manifolds 41 can thus have uniform flowability of ink from the upper supply manifold 51.

In the seventh modified example, the discharge connection opening 172 farther away from the discharge opening 152 in the conveyance direction and disposed at the more upstream side in the conveyance direction has a larger cross-sectional area orthogonal to the up-down direction. This allows the discharge connection opening 172 farther away from the discharge opening 152 and disposed at the more upstream side in the conveyance direction to have a smaller channel resistance. The lower discharge manifolds 42 can thus have uniform flowability of ink into the upper discharge manifold 151.

In the above embodiment, the pump is provided in only one of the channel connecting the ink tank and the supply opening and the channel connecting the ink tank and the discharge opening. The present disclosure, however, is not limited thereto. For example, pumps may be provided in both the channel connecting the ink tank and the supply opening and the channel connecting the ink tank and the discharge opening.

When the pumps are provided in the both channels, the supply connection openings may have different cross-sectional areas orthogonal to the up-down direction and the discharge connection openings may have different cross-sectional areas orthogonal to the up-down direction, depending on a magnitude relationship between the ink amounts pumped by the two pumps per unit time, a distribution of the channel resistance in part of each ink channel in the head unit 11, and the like. Namely, like the above embodiment and the first to fifth modified examples, the supply connection opening and the discharge connection opening farther away from the supply opening in the conveyance direction may each have a larger cross-sectional area orthogonal to the up-down direction. Alternatively, like the sixth and seventh modified examples, the supply connection opening and the discharge connection opening farther away from the discharge opening in the conveyance direction may each have a larger cross-sectional area orthogonal to the up-down direction. The individual channels 20 can thus have a uniform ink circulation amount similarly to the above.

Further, the pump may be provided in only one of the channel connecting the ink tank and the supply opening and the channel connecting the ink tank and the discharge opening. In that case, the supply connection opening and the discharge connection opening farther away from the supply opening in the conveyance direction may each have a larger cross-sectional area orthogonal to the up-down direction, and the supply connection opening and the discharge connection opening farther away from the discharge opening in the conveyance direction may each have a larger cross-sectional area orthogonal to the up-down direction.

In the above embodiment, the four supply connection openings have different cross-sectional areas orthogonal to the up-down direction, and the four discharge connection openings have different cross-sectional areas orthogonal to the up-down direction. The present disclosure, however, is not limited thereto. For example, the four supply connection openings may have different cross-sectional areas orthogonal to the up-down direction, and the four discharge connection openings may have the same cross-sectional area orthogonal to the up-down direction. Alternatively, the four supply connection openings may have the same cross-sectional area orthogonal to the up-down direction, and the four discharge connection openings may have different cross-sectional areas orthogonal to the up-down direction.

In the above embodiment, at least any of the four supply connection openings 46 and the four discharge connection openings 47 have mutually different cross-sectional areas orthogonal to the up-down direction. The present disclosure, however, is not limited thereto.

For example, in the above embodiment, two supply connection openings 46 included in the four supply connection openings 46 and disposed at the upstream side in the conveyance direction may have the same cross-sectional area, and two supply connection openings 46 included in the four supply connection openings 46 and disposed at the downstream side in the conveyance direction may have the same cross-sectional area. Further, the cross-sectional area of the two supply connection openings 46 disposed at the upstream side in the conveyance direction may be different from the cross-sectional area of the two supply connection openings 46 disposed at the downstream side in the conveyance direction. In that configuration, the two supply connection openings 46 included in the four supply connection openings 46 and disposed at the upstream side in the conveyance direction correspond to the first supply connection opening of the present disclosure. The two supply connection openings 46 included in the four supply connection openings 46 and disposed at the downstream side in the conveyance direction correspond to the second supply connection opening of the present disclosure.

In the above embodiment, the two first supply connection openings and the two second supply connection openings are provided. The number of the first supply connection openings and the number of the second supply connection openings may be different from the above embodiment. Further, the supply connection openings 46 may have three or more different cross-sectional areas without being limited to the two different cross-sectional areas as described above.

For example, in the above embodiment, two discharge connection openings 47 included in the four discharge connection openings 47 and disposed at the upstream side in the conveyance direction may have the same cross-sectional area, and two discharge connection openings 47 included in the four discharge connection openings 47 and disposed at the downstream side in the conveyance direction may have the same cross-sectional area. Further, the cross-sectional area of the two discharge connection openings 47 disposed at the upstream side in the conveyance direction may be different from the cross-sectional area of the two discharge connection openings 47 disposed at the downstream side in the conveyance direction. In that configuration, the two discharge connection openings 47 included in the four discharge connection openings 47 and disposed at the upstream side in the conveyance direction correspond to the first discharge connection opening of the present disclosure. The two discharge connection openings 47 included in the four discharge connection openings 47 and disposed at the downstream side in the conveyance direction correspond to the second discharge connection opening of the present disclosure.

In the above embodiment, the two first discharge connection openings and the two second discharge connection openings are provided. The number of the first discharge connection openings and the number of the second discharge connection openings may be different from the above embodiment. Further, the discharge connection openings 47 may have three or more different cross-sectional areas without being limited to the two different cross-sectional areas as described above.

In the above embodiment, the four lower supply manifolds are connected to the upper supply manifold. The present disclosure, however, is not limited thereto. Two lower supply manifolds, three lower supply manifolds, or five or more lower supply manifolds may be connected to the upper supply manifold.

In the above embodiment, the four lower discharge manifolds are connected to the upper discharge manifold. The present disclosure, however, is not limited thereto. Two lower discharge manifolds, three lower discharge manifolds, or five or more lower discharge manifolds may be connected to the upper discharge manifold.

In the above embodiment, each of the supply connection openings 46 overlaps in the up-down direction with the end of the corresponding one of the lower supply manifolds 41, and each of the discharge connection openings 47 overlaps in the up-down direction with the end of the corresponding one of the lower discharge manifolds 42. The present disclosure, however, is not limited thereto. Each of the supply connection openings 46 may overlap in the up-down direction with an intermediate (middle) portion of the corresponding one of the lower supply manifolds 41, and the pressure chamber row 8 and the nozzle row 9 may extend over the ends in the sheet width direction of the supply connection opening 46. Further, each of the discharge connection openings 47 may overlap in the up-down direction with an intermediate (middle) portion of the corresponding one of the lower discharge manifolds 42, and the pressure chamber row 8 and the nozzle row 9 may extend over the ends in the sheet width direction of the discharge connection opening 47.

In the above embodiment, the four lower supply manifolds 41 and the four lower discharge manifolds 42 are formed in the channel plate 36 of the head unit 11. The present disclosure, however, is not limited thereto. The four lower supply manifolds 41 and the four lower discharge manifolds 42 may pass through two or more channel plates stacked on top of each other.

In the above embodiment, the upper supply manifold 51 and the upper discharge manifold 52 are formed in the channel plate 36 of the head unit 11. The present disclosure, however, is not limited thereto. The upper supply manifold 51 and the upper discharge manifold 52 may pass through two or more channel plates stacked on top of each other.

In the above embodiment, the four supply connection openings 46 and the four discharge connection openings 47 are formed in the channel plate 37 of the head unit 11. The present disclosure, however, is not limited thereto. The four supply connection openings 46 and the four discharge connection openings 47 may pass through two or more channel plates stacked on top of each other. In that case, provided that the sizes of the supply connection openings 46 and the discharge connection openings 47 in at least one of the channel plates are the same as those in the above embodiment, the sizes of the supply connection openings 46 and the discharge connection openings 47 in the remaining channel plates may be different from each other.

In the above embodiment, the supply opening 56 and the discharge opening 57 are formed in the channel plate 39 of the head unit 11. The present disclosure, however, is not limited thereto. The supply opening 56 and the discharge opening 57 may pass through two or more channel plates stacked on top of each other. In that case, provided that the sizes of the supply opening 56 and the discharge opening 57 in at least one of the channel plates are the same as those in the above embodiment, the sizes of the supply openings 56 and the discharge openings 57 in the remaining channel plates may be different from each other.

In the above embodiment, the ink flowing direction may be reversed. Namely, the channel for discharging ink from the individual channels 20 to the ink tank 60 in the above embodiment may be used as the channel for supplying ink from the ink tank 60 to the individual channels 20. Further, the channel for supplying ink from the ink tank 60 to the individual channels 20 in the above embodiment may be used as the channel for discharging ink from the individual channels 20 to the ink tank 60.

The explanation is made above about the examples in which the present disclosure is applied to the ink-jet head discharging ink from nozzles and the printer including the ink-jet head. The present disclosure, however, is not limited thereto. The present disclosure is applicable to a liquid discharge head discharging any other liquid than ink from nozzles and a liquid discharge apparatus including the liquid discharge head.

What is claimed is:

1. A liquid discharge head, comprising:

a plurality of individual channels including a plurality of nozzles respectively, a plurality of first supply channels through which liquid is supplied to the individual channels, the first supply channels extending in a first direction and connected to the individual channels, and the first supply channels being arranged in a second direction intersecting with the first direction, a plurality of first discharge channels through which the liquid is discharged from the individual channels, the first discharge channels extending in the first direction and connected to the individual channels, and the first discharge channels being arranged in the second direction, a second supply channel through which the liquid is supplied to the first supply channels, the second supply channel extending in the second direction and overlapping with the first supply channels in a third direction that intersects with a plane parallel to the first direction and the second direction, a second discharge channel to which the liquid is discharged from the first discharge channels, the second discharge channel extending in the second direction and overlapping with the first discharge channels in the third direction, a plurality of supply connection openings positioned between the first supply channels and the second supply channel in the third direction and connecting the first supply channels and the second supply channel, a plurality of discharge connection openings positioned between the first discharge channels and the second discharge channel in the third direction and connecting the first discharge channels and the second discharge channel, a supply opening through which the liquid is supplied to the second supply channel, and a discharge opening to which the liquid is discharged from the second discharge channel, wherein the supply connection openings include a first supply connection opening and a second supply connection opening, the discharge connection openings include a first discharge connection opening and a second discharge connection opening, the liquid discharge head satisfies at least one of the following: a cross-sectional area orthogonal to the third direction of the first supply connection opening is different from a cross-sectional area orthogonal to the third direction of the second supply connection opening, and a cross-sectional area orthogonal to the third direction of the first discharge connection opening is different from a cross-sectional area orthogonal to the third direction of the second discharge connection opening.

2. The liquid discharge head according to claim 1, wherein the second supply connection opening is farther away from the supply opening than the first supply connection opening, and the cross-sectional area orthogonal to the third direction of the second supply connection opening is larger than that of the first supply connection opening.

3. The liquid discharge head according to claim 2, wherein the second supply connection opening is longer in the first direction than the first supply connection opening.

4. The liquid discharge head according to claim 2, wherein an inner wall surface of each of the supply connection openings has:

a first surface extending in the first direction;

a second surface connected to a first end in the first direction of the first surface and extending in the second direction from a connection portion with the first surface;

a third surface connected to a second end in the first direction of the first surface and extending in the second direction from a connection portion with the first surface; and a first curved surface connecting an end of the second surface on a side opposite to the connection portion with the first surface and an end of the third surface on a side opposite to the connection portion with the first surface, at least part of the first curved surface curving to be convex in a direction away from the first surface, each of the supply connection openings has a first convex portion positioned on a side opposite to the first surface with respect to a straight line passing through a connection portion that connects the second surface and the first curved surface and a connection portion that connects the third surface and the first curved surface, and a cross-sectional area orthogonal to the third direction of the first convex portion of the second supply connection opening is larger than a cross-sectional area orthogonal to the third direction of the first convex portion of the first supply connection opening.

5. A liquid discharge apparatus comprising:

the liquid discharge head as defined in claim 2; and a pump connected to the second supply channel via the supply opening and configured to feed the liquid toward the second supply channel.

6. The liquid discharge head according to claim 1, wherein the supply connection openings are rectangles and include a longest supply connection opening that is the longest in the first direction, and the longest supply connection opening has a length in the first direction that is longer than a length in the second direction.

7. The liquid discharge head according to claim 6, wherein the longest supply connection opening has the length in the first direction that is more than 1.3 times the length in the second direction.

8. The liquid discharge head according to claim 6, wherein the longest supply connection opening has the length in the first direction that is not less than 0.9 mm and not more than 1.8 mm.

9. The liquid discharge head according to claim 1, wherein the supply connection openings are rectangles and include a shortest supply connection opening that is the shortest in the first direction, and the shortest supply connection opening has a length in the first direction that is shorter than a length in the second direction.

10. The liquid discharge head according to claim 9, wherein the shortest supply connection opening has the length in the first direction that is not less than 0.45 mm and not more than 0.9 mm.

11. The liquid discharge head according to claim 1, wherein the second discharge connection opening is farther away from the supply opening than the first discharge connection opening, and a cross-sectional area orthogonal to the third direction of the second discharge connection opening is larger than that of the first discharge connection opening.

12. The liquid discharge head according to claim 11, wherein the second discharge connection opening is longer in the first direction than the first discharge connection opening.

13. The liquid discharge head according to claim 12, wherein the discharge connection openings are rectangles and include a longest discharge connection opening that is the longest in the first direction, and the longest discharge connection opening has a length in the first direction that is longer than a length in the second direction.

14. The liquid discharge head according to claim 13, wherein the longest discharge connection opening has the length in the first direction that is more than 1.3 times the length in the second direction.

15. The liquid discharge head according to claim 13, wherein the longest discharge connection opening has the length in the first direction that is not less than 0.9 mm and not more than 1.8 mm.

16. The liquid discharge head according to claim 12, wherein the discharge connection openings are rectangles and include a shortest discharge connection opening that is the shortest in the first direction, and the shortest discharge connection opening has a length in the first direction that is shorter than a length in the second direction.

17. The liquid discharge head according to claim 16, wherein the shortest discharge connection opening has the length in the first direction that is not less than 0.45 mm and not more than 0.9 mm.

18. The liquid discharge head according to claim 1, wherein an inner wall surface of each of the discharge connection openings has:

a fourth surface extending in the first direction;

a fifth surface connected to a first end in the first direction of the fourth surface and extending in the second direction from a connection portion with the fourth surface;

a sixth surface connected to a second end in the first direction of the fourth surface and extending in the second direction from a connection portion with the fourth surface; and a second curved surface connecting an end of the fifth surface on a side opposite to the connection portion with the fourth surface and an end of the sixth surface on a side opposite to the connection portion with the fourth surface, at least part of the second curved surface curving to be convex in a direction away from the fourth surface, each of the discharge connection openings has a second convex portion positioned on a side opposite to the fourth surface with respect to a straight line passing through a connection portion that connects the fifth surface and the second curved surface and a connection portion that connects the sixth surface and the second curved surface, and a cross-sectional area orthogonal to the third direction of the second convex portion of the second discharge connection opening is larger than a cross-sectional area orthogonal to the third direction of the second convex portion of the first discharge connection opening.

19. The liquid discharge head according to claim 1, wherein the second supply connection opening is farther away from the discharge opening than the first supply connection opening in the second direction, and a cross-sectional area orthogonal to the third direction of the second supply connection opening is larger than that of the first supply connection opening.

20. A liquid discharge apparatus comprising:

the liquid discharge head as defined in claim 19; and a pump connected to the second discharge channel via the discharge opening and configured to discharge the liquid from the second discharge channel.

21. The liquid discharge head according to claim 1, wherein the second discharge connection opening is farther away from the discharge opening than the first discharge connection opening in the second direction, and a cross-sectional area orthogonal to the third direction of the second discharge connection opening is larger than that of the first discharge connection opening.

* * * * *